United States Patent [19]

Staropoli

[11] 4,453,787

[45] Jun. 12, 1984

[54] INTERCHANGEABLE FILE CABINET LOCK ASSEMBLY

[76] Inventor: Paul R. Staropoli, 2020 Holiday Park Dr., Pittsburgh, Pa. 15239

[21] Appl. No.: 272,789

[22] Filed: Jun. 11, 1981

[51] Int. Cl.[3] ..... E05B 65/46; E05C 15/04

[52] U.S. Cl. ..... 312/215; 312/218; 312/221; 312/222; 312/107.5

[58] Field of Search ..... 312/215, 216, 217, 218, 312/219, 220, 221, 222, 107.5

[56] References Cited

U.S. PATENT DOCUMENTS

| | | | |
|---|---|---|---|
| 681,155 | 8/1901 | Tobey | 312/107.5 |
| 2,273,151 | 2/1942 | Siegel | 312/218 |
| 2,276,197 | 3/1942 | Houston et al. | 312/218 |
| 2,653,070 | 9/1953 | McClellan . | |
| 2,966,384 | 12/1960 | Bergman | 312/218 |
| 3,284,149 | 11/1966 | Lewin | 312/218 |
| 3,325,234 | 6/1967 | Lewin . | |
| 3,497,280 | 2/1970 | Olree et al. | 312/219 |
| 3,767,280 | 10/1973 | McLaughlin . | |
| 3,774,985 | 11/1973 | Chovanec et al. | 312/217 |
| 3,936,108 | 2/1976 | Chitester | 312/217 |
| 3,957,324 | 5/1976 | Klenik, Jr. et al. | 312/217 |
| 4,057,306 | 11/1977 | Resch, Jr. . | |
| 4,066,308 | 1/1978 | Wedel . | |
| 4,092,056 | 5/1978 | Signore et al. . | |
| 4,168,103 | 9/1979 | Hagen . | |
| 4,246,769 | 1/1981 | McLaughlin . | |

*Primary Examiner*—Victor N. Sakran

[57] ABSTRACT

An interchangeable lock assembly for a vertical file cabinet having plurality of drawers includes a self-locating bracket affixed to the interior cabinet side adjacent the cabinet top, a lock bar extending vertically along the cabinet side between the cabinet drawers for engaging and disengaging the drawers, a lock operating arm pivotally connected to the bracket and a lock which may be either of the rotary type or the plunger type for engaging different respective surfaces of the lock operating arm to cause the lock operating arm to vertically move the lock bar.

9 Claims, 10 Drawing Figures

INTERCHANGEABLE FILE CABINET LOCK ASSEMBLY

FIELD OF THE INVENTION

My invention relates to a locking system for the drawers of a file cabinet and, more particularly, to a lock operating arm arrangement operable through either a rotary lock or a plunger lock.

DESCRIPTION OF THE PRIOR ART

A variety of locking systems has been developed for file cabinets and other articles of furniture having a plurality of vertically assembled drawers. In general, a lock bar or lock bars extend vertically between the drawers and the interior side wall of the cabinet. The lock bar or lock bars include spaced tabs which cooperate with stops or openings along the drawer side so as to cause a locking or unlocking of all the drawers.

The locks themselves are generally of the rotary or plunger type. The rotary lock is of a more simple construction and is thusly cheaper to manufacture. The plunger lock, on the other hand, permits a visual detection as to whether or not the file drawers are locked and this is a valuable asset where confidential and like material is being stored and it is necessary to maintain a check for the locked position.

While the lock bar itself is normally a part of the file cabinet, the lock is added later by or at the request of the purchaser. Heretofore, different mechanisms have been employed to transmit the motion of the different locks to the lock bar.

Exemplary of the patents teaching different locking systems are U.S. Pat. Nos. 2,273,151, 4,066,308, 3,767,280, 3,936,108, 3,325,234, 2,653,070, 4,168,103, 3,497,280, 4,092,056, 4,057,306, 3,957,324, and 4,246,769.

SUMMARY OF THE INVENTION

My lock assembly includes a lock operating arm which is operable through either a rotary lock or a plunger lock. Therefore, a single mechanism can be provided which is applicable with either type of lock and the locks become easily interchangeable as desired.

The lock operating arm is pivotally connected to a self-locating bracket at a pivot point and includes a first end having a top surface spaced vertically above and upstream of the pivot point and a second end including a bottom surface spaced vertically below and downstream of the pivot point. The bottom surface defines a cam slide which terminates in an attachment means for engaging the lock bar. Generally, a rotary lock includes a vertically movable lock cam having a roll pin for engagement with the top surface of the lock operating arm. The plunger lock includes a plunger arm terminating in a normally depending leg for engagement with the bottom surface cam slide.

DESCRIPTION OF THE PREFERRED EMBODIMENTS

Figure 1:
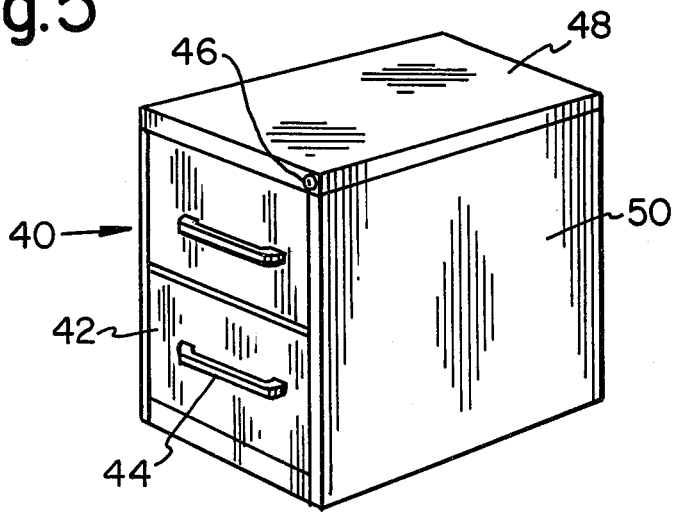
FIG. 1 is a perspective view of a two drawer vertical file cabinet.

A typical vertical filing cabinet, generally designated 40, includes a plurality of vertically stacked drawers 42 operable by individual handles 44, FIG. 1. The cabinet 40 also includes a cabinet top 48 and sides 50 as well as a back, not shown. Cabinet 40 is normally manufactured with a knockout plug which can be removed and replaced with a lock 46. Although not shown in full detail it will be recognized by those skilled in the art that a lock bar extends vertically alongside the drawers. The lock bar has a plurality of tabs or other protuberances which are spaced and positioned to engage openings or stops associated with each drawer so as the lock bar is vertically lifted through actuation of the lock 46, the drawers are either entirely locked or unlocked as the case may be. The above referenced patents illustrate a variety of configurations to accomplish this objective.

Figure 7:
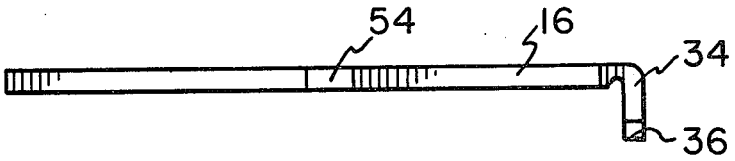
FIG. 7 is a plan view of the lock operating arm.
Figure 8:
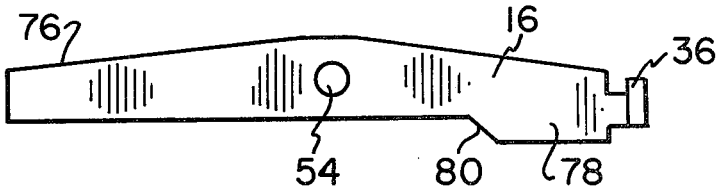
FIG. 8 is a front elevation of the lock operating arm.
Figure 9:
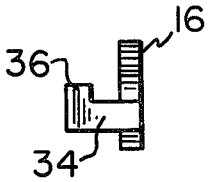
FIG. 9 is a side elevation of the lock operating arm.

The key member to my interchangeable lock assembly is the lock operating arm 16 best seen in FIGS. 7 through 9. The lock operating arm 16 includes a central opening 54 through which it is pivotably connected as will be described in detail hereinafter. Upstream of the opening 54 is an inclined top surface 76. Downstream of the opening 54 is an enlarged section 78 which defines an inclined cam slide 80. Enlarged section 78 terminates in a finger extending normal to the remainder of the lock operating arm. Finger 34, in turn, terminates in an upstanding hook 36 which retains the lock operating arm 16 to the lock bar 12.

Figure 4:
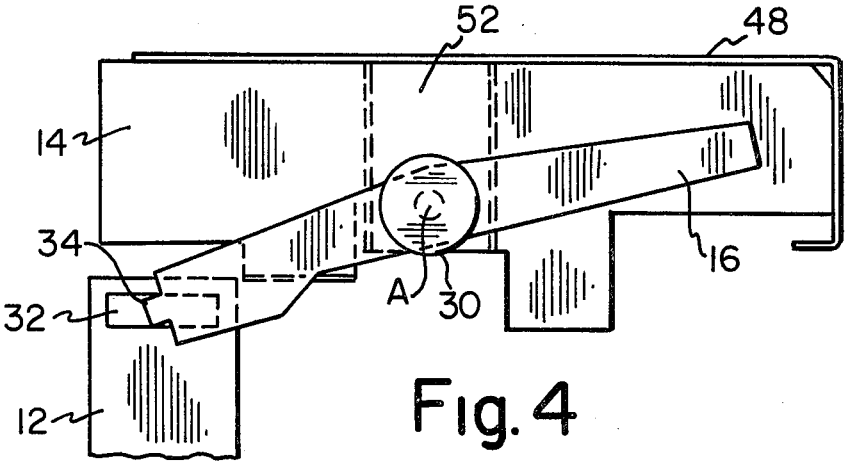
FIG. 4 is a front elevation showing the attachment of the lock operating arm to the lock bar and self-locating bracket.
Figure 2:
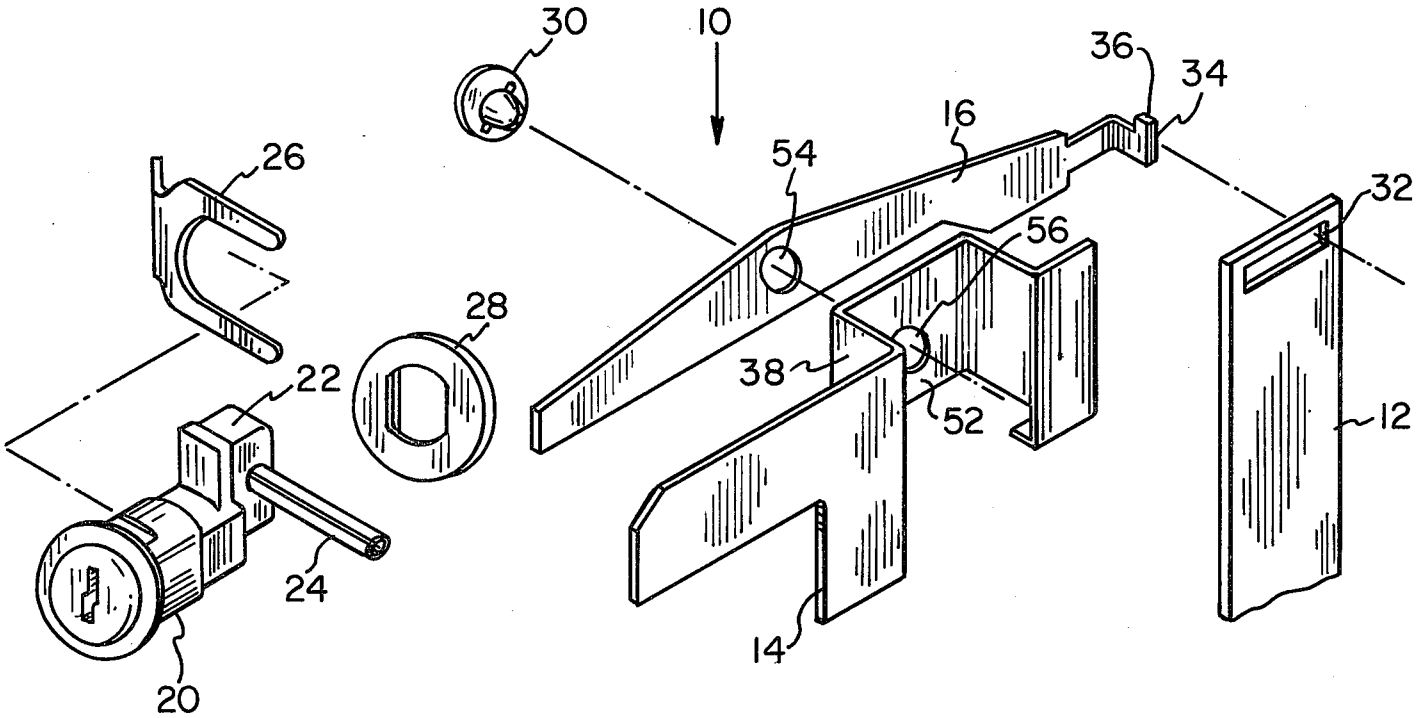
FIG. 2 is an exploded view of my interchangeable lock assembly actuated by a rotary lock.
Figure 3:
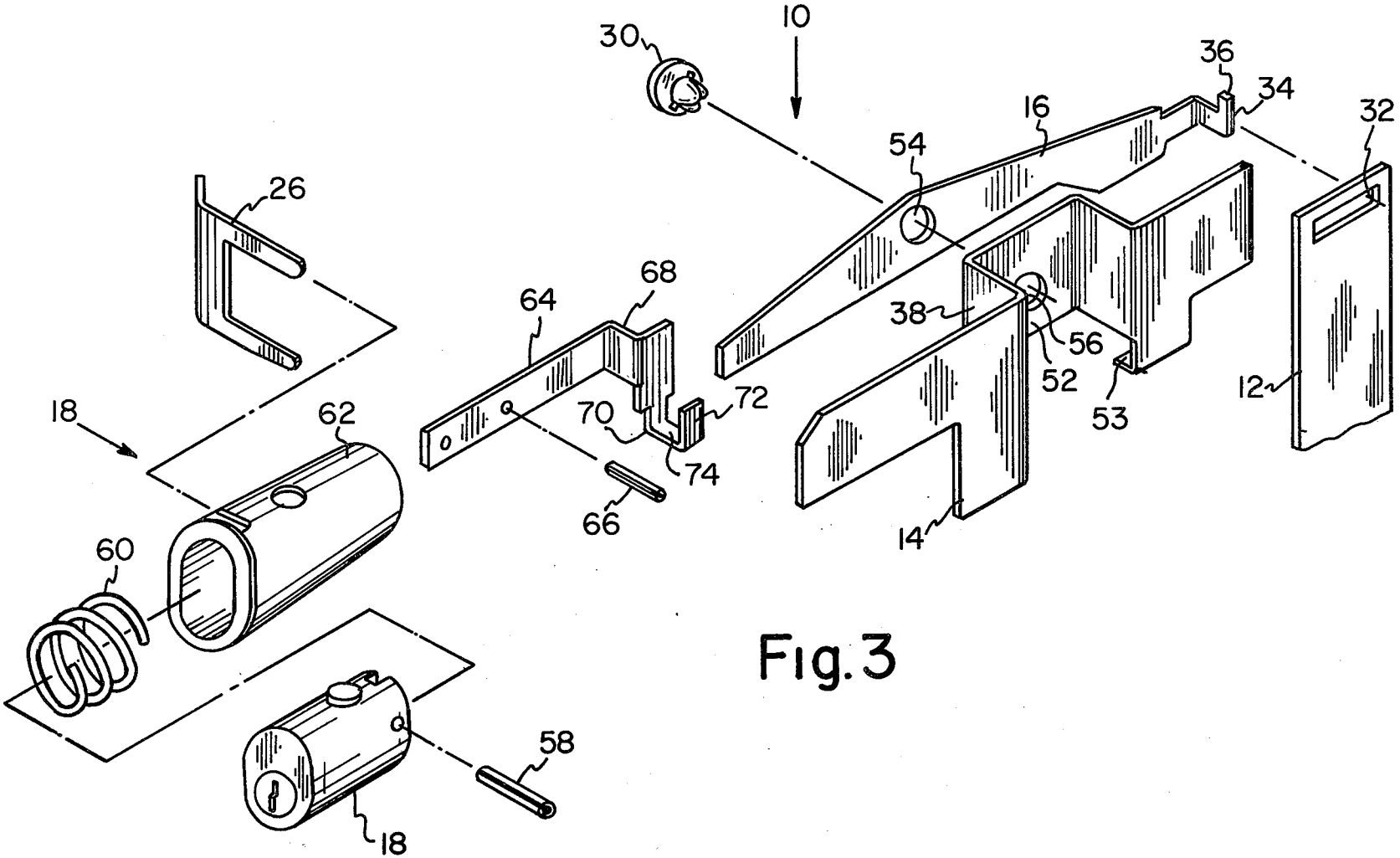
FIG. 3 is an exploded view of my interchangeable lock assembly actuated by a plunger lock.

The lock operating arm 16 is pivotably connected to a self-locating bracket 14, FIGS. 2 through 4. Self-locating bracket 14 includes an outwardly depending channel 38 which terminates in a web 52. An opening 56 extends through the web 52 which is aligned with opening 54 of the lock operating arm 16 and joined thereto by means of a push-in fastener 30 or other suitable pivotably connecting means. A formed lip 53 acts as a support and travel slide for the plunger lock arm as will be described hereinafter. The bracket 14 is termed self-locating since it is dimensioned to fit in abutting relationship to the interior of the cabinet top 48 and to be tack welded to the cabinet side 50 at the front interior of the cabinet 40. Once so positioned the lock operating arm 16 will be in proper location with respect to the lock and to the lock bar.

The interchangeable lock assembly, generally designated 10, including a rotary lock 20 is illustrated in FIG. 2. The rotary lock 20 includes a lock cam 22 adapted for up and down vertical movement when actuated by a key (not shown). Extending outward from the lock cam 22 and normal thereto is a roll pin 24. An escutcheon 28 fits over the lock 20 to fill in any extra space when the knockout is removed from the cabinet wall. The rotary lock is retained in place by means of a lock clip 26.

The interchangeable lock assembly 10 utilizing a plunger lock 18 is illustrated in FIG. 3. The plunger lock 18 is housed within lock sleeve 62. Extending into sleeve 62 and connecting with the plunger 18 by means of pin 58 is plunger lock arm 64. Pin 66 acts as a plunger lock travel stop. Plunger lock arm 64 terminates in a normally outwardly extending leg 68 which has at its distal end a depending channel 70. Channel 70 comprises opposing flanges 72 joined by web 74.

Figure 5:
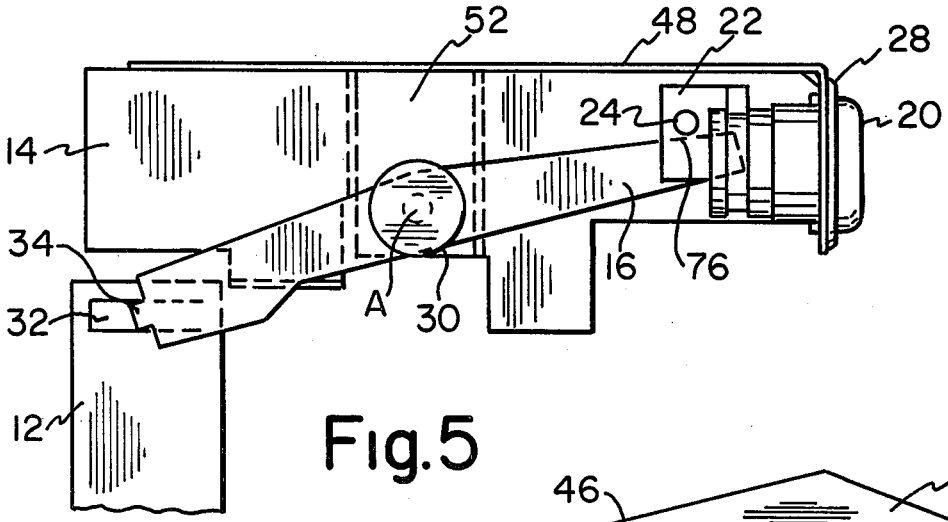
FIG. 5 is a front elevation of my interchangeable lock assembly actuated by a rotary lock.
Figure 6:
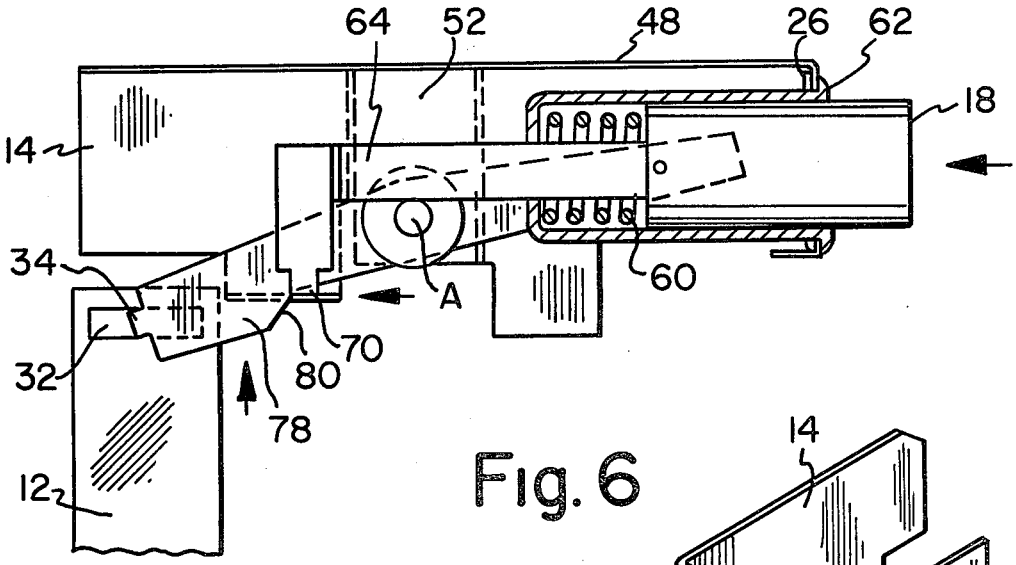
FIG. 6 is a front elevation of my interchangeable lock assembly actuated by a plunger lock.

The operation of the interchangeable lock assembly is best seen in FIGS. 5 and 6 where lock operating arm 16 is pivotably mounted to self-locating bracket 14 which has been tack welded (not shown) to the interior cabinet side 50 in abutting relationship to the cabinet front and top 48. The lock operating arm 16 pivots about point A. At its extreme downstream end, arm 16 connects to lock bar 12 through the engagement of finger 34 in slot 32 of the lock bar 12.

When used with the rotary lock 20, FIGS. 2 and 5, the upstream end of arm 16 and particularly the top surface 76 thereof is engaged by roll pin 24 which extends from lock cam 22. As a key (not shown) is turned in rotary lock 20, lock cam 22 moves downward causing arm 16 to pivot about point A thereby lifting lock bar 12 into engagement with the drawers so as to assume the locked position. When the key is turned in the reverse direction the lock cam 22 returns to the position in FIG. 5 permitting lock bar 12 to move downward into an unlocked position.

When used with the plunger lock 18, FIGS. 3 and 6, the upstream end of arm 16 is not engaged. However, the plunger lock arm 64 and, more particularly, the web 74 of channel 70 rides against cam slide 80 of the lock operating arm 16. Lip 53 of self-locating bracket 14 acts as a support and travel slide for channel 70. When plunger lock 18 is pushed inward, channel 70 moves along cam slide 80 causing arm 16 to pivot about point A and lock bar 12 is moved upward into the locked position with respect to the drawers. When the key (not shown) is turned in plunger lock 18, return spring 60 urges lock 18 and plunger lock arm 64 back to the position of FIG. 6. Again lock operating arm 16 pivots about point A as the channel 70 moves rearward along cam slide 80 and lock bar 12 moves downward to an unlocked position with respect to the drawers.

Figure 10:
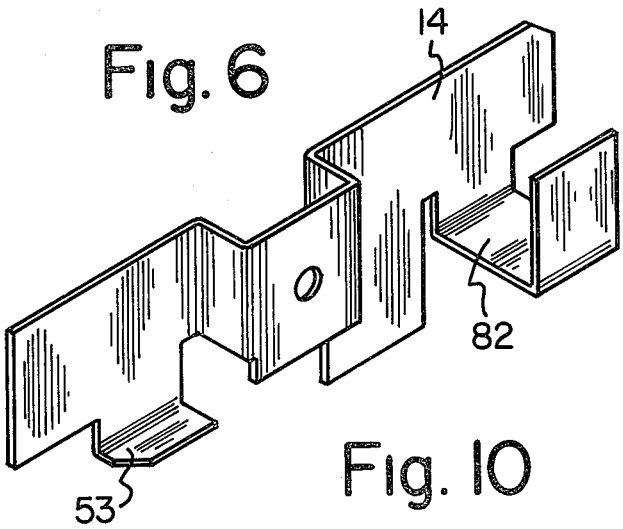
FIG. 10 is a perspective view of a modified self-locating bracket.

A modified form of the self-locating bracket 14 is illustrated FIG. 10. This modification is particularly useful when used with the plunger lock. An L-shaped web 82 extends outward from bracket 14. L-shaped web 82 prevents any sidewise motion of lock arm 64 thereby assuring proper cooperation of the web 70 and the cam slide 80.

I have thereby provided an interchangeable lock assembly operable from a single lock operating arm mechanical arrangement.

The foregoing specification is exemplary of preferred embodiments and it is understood that many of the details may be varied without departing from the scope of the invention.

I claim:

1. An interchangeable lock assembly for a vertical file cabinet having a plurality of drawers and a lock bar extending vertically between the drawers and an interior cabinet side and movable from a first position for lockably engaging the drawers and a second position for disengaging the drawers comprising A. a lock operating arm having a first end and a second end, said first end including a top surface, said second end including a bottom surface and terminating in means for engaging the lock bar, said lock operating arm further including a central pivot point, an area along said top surface spaced vertically above and upstream of said pivot point adapted for engagement by a rotary lock cam and an area along said bottom surface spaced vertically below and downstream of said pivot point and defining a cam slide adapted for engagement by a plunger lock arm, B. means for pivotably connecting the lock operating arm between the first and second end to the cabinet, and C. a lock for engaging one of said top and bottom surfaces to operate said lock bar between its first and second position.

2. The assembly of claim 1, said cam slide being an inclined surface joining a portion of the bottom surface downstream of the pivot point and an enlarged section from which the lock bar engaging means extends.

3. The assembly of claim 2 or 1, said pivotably connecting means comprising a locating bracket affixed to the cabinet interior and positioned on said cabinet side adjacent to a cabinet top, said bracket having a channel-shaped extension terminating in a web, said web being pivotably attached to the lock operating arm to locate said web with respect to either of said locks.

4. An interchangeable lock assembly for a vertical file cabinet having a plurality of drawers and a cabinet interior formed of a cabinet top and at least one cabinet side comprising A. a self-locating bracket affixed to the cabinet side substantially abutting said cabinet top, said bracket having a channel-shaped exterior terminating in a web, said web including an opening therethrough, B. a lock bar extending vertically between the drawers and the cabinet side and movable from a first position for lockably engaging the drawers and a second position for disengaging the drawers, C. a lock operating arm pivotably connected to said bracket at said web opening to form a pivot point and a first end including a top surface spaced vertically above and upstream of said pivot point and a second end including a bottom surface spaced vertically below and downstream of said pivot point and defining a cam slide, said second end terminating in a tab extending normally to said arm and engaging said lock bar, D. a lock for engaging one of said top and bottom surfaces to operate said lock bar between its first and second position.

5. The assembly of claim 4, said lock being a rotary lock and including a vertically movable lock cam having a roll pin extending out therefrom, said roll pin engaging said top surface.

6. The assembly of claim 4, said lock being a plunger lock including a plunger arm terminating in a normally depending leg for slidable engagement with the cam slide.

7. The assembly of claim 6, said leg terminating in a depending channel member having flanges joined by a web, said web positioned for slidable engagement with the cam side.

8. The assembly of claim 7, wherein the self-locating bracket includes an outwardly extending lip which cooperates with said depending channel.

9. The assembly of claim 4, said self-locating bracket including an outwardly extending L-shaped web.

* * * * *